United States Patent [19]

Berrigan

[11] Patent Number: 4,480,598

[45] Date of Patent: Nov. 6, 1984

[54] COOLANT RECOVERY AND DE-AERATION SYSTEM FOR LIQUID-COOLED INTERNAL COMBUSTION ENGINES

[75] Inventor: James H. Berrigan, Mesa, Ariz.

[73] Assignee: William C. Neils, Phoenix, Ariz.

[21] Appl. No.: 534,316

[22] Filed: Sep. 22, 1983

[51] Int. Cl.[3] ..... F01P 11/02

[52] U.S. Cl. ..... 123/41.27; 123/41.51; 123/41.54

[58] Field of Search ..... 123/41.27, 41.2, 41.21, 123/41.23, 41.51, 41.54; 165/51, 110, 111

[56] References Cited

U.S. PATENT DOCUMENTS

| | | | |
|---|---|---|---|
| Re. 27,965 | 4/1974 | Avrea | 165/107 |
| 3,576,181 | 4/1971 | Neal | 123/41.51 |
| 3,604,502 | 9/1971 | Morse | 165/51 |
| 3,623,462 | 11/1971 | Anders et al. | 123/41.27 |
| 3,726,262 | 4/1973 | Moon | 123/41.54 |
| 3,759,233 | 9/1973 | Schlaffer et al. | 113/41.1 |
| 3,853,270 | 12/1974 | Prebil | 123/41.14 |
| 4,006,775 | 2/1977 | Avrea | 165/51 |
| 4,064,848 | 12/1977 | Pabst et al. | 123/41.54 |
| 4,175,616 | 11/1979 | Pabst et al. | 165/107 |
| 4,422,502 | 12/1983 | Villeval | 123/41.51 |

*Primary Examiner*—William A. Cuchlinski, Jr.
*Attorney, Agent, or Firm*—LaValle D. Ptak

[57] ABSTRACT

A coolant accumulator for use with the cooling system of an internal combustion engine, having a cooling radiator with a filler opening in it, provides positive anti-aeration of the engine cooling system and positive recovery of all coolant. This is accomplished by mounting a dual-compartment recovery tank above the filler opening of the radiator to permit free flow of fluid between the filler opening of the radiator and the bottom of a high pressure compartment of the tank. A pressure-actuated one-way valve is located in a passage interconnecting the top of the high pressure compartment with a second compartment. The valve is opened when the pressure in the radiator (and consequently, the high pressure tank) is a predetermined amount above ambient atmospheric pressure to permit fluid to flow from the high pressure compartment in the second compartment. The second compartment is vented to the atmosphere and has a filler opening in it to permit the addition of liquid coolant to it. The bottom of the second compartment either communicates directly through a gravity-operated check valve to permit flow into the top of the high pressure compartment or, alternatively, is connected through the gravity-operated check valve to the filler opening of the radiator. Thus, in the event of the loss of pressurization in the cooling system of the vehicle coolant flows by means of gravity out of both compartment into the vehicle cooling system. Lack of coolant in either of the compartments is a positive indication of a fluid leak somewhere in the engine cooling system and the accessories connected thereto.

14 Claims, 7 Drawing Figures

COOLANT RECOVERY AND DE-AERATION SYSTEM FOR LIQUID-COOLED INTERNAL COMBUSTION ENGINES

BACKGROUND OF THE INVENTION

In cooling systems for liquid-cooled internal combustion engines, it has become common practice to utilize accumulator tanks for accumulating and returning make-up coolant to the radiator of the vehicle in which the engine is installed. In addition, such systems generally provide for an automatic positive anti-aeration system to eliminate entrapped air and other gasses from the liquid coolant, thereby increasing the efficiency of the cooling system associated with the engine.

Typical systems for accomplishing the above results are illustrated in the patents to Walter C. Avrea, No. RE 27,965, and No. 4,006,775. The system disclosed in the '965 reissue patent includes a plastic bottle forming a coolant reservoir and coolant overflow accumulator. This bottle is located in a position in the vehicle generally alongside the radiator. A specially constructed radiator cap having a two-way check valve replaces the conventional radiator cap and a length of tubing extends from the radiator cap overflow outlet to the reservoir bottle. When the pressure in the cooling system exceeds a pre-established amount, the first check valve in the radiator cap opens to allow air and coolant to escape into the reservoir bottle. Upon cool-down of the system, the other check valve in the cap opens in response to the vacuum condition created in the vehicle cooling system to withdraw fluid from the bottle and return it to the engine cooling system.

A primary disadvantage in this system is the necessity of the special radiator cap requiring the built-in, two-way check valve or two separate check valves. In addition, if there is a leak somewhere in the vehicle cooling system which breaks the vacuum upon cool-down of the system, coolant liquid is not withdrawn from the reservoir bottle since the necessary vacuum to open the check valve and cause this to occur is not present. Consequently, it is possible for a user of the system to check the reservoir bottle, see that it is full of fluid, and mistakenly believe that the cooling system for the engine is full of liquid coolant when, in fact, it could be dangerously low in coolant.

The Avrea patent, No. 4,006,775, is a modification of the system shown in the '965 reissue patent. In the '775 patent, the special radiator valve is not employed. Instead, the radiator is constructed either as a unitary device or with a separate accumulator tank alongside the radiator to permit overflow through a first check valve into the accumulator and return through a second check valve (which may be a gravity-opened check valve) at the bottom of the radiator, communicating in a passageway between the bottom of the accumulator tank and the bottom of the radiator. The system of the '775 patent eliminates the necessity for the special radiator cap. The system disclosed, however, still is subject to the disadvantage that it is possible for liquid to appear in the accumulator tank above the bottom passageway and still have a dangerously low coolant level in the vehicle cooling system, including the engine and radiator.

Other prior art systems for removing air and other gasses from the coolant in the vehicle cooling system are disclosed in the patents to Pabst, No. 4,064,848 and 4,175,616. In the Pabst system, a separate equalization tank (either independent or built in as the upper portion of the vehicle radiator) is utilized with baffles for separating the air bubbles in the coolant supplied to the tank from coolant returning from the tank and returned to the vehicle cooling system. A single tank is employed, and there is no separate pressure check valve to admit fluid into the tank or to permit fluid to return from the tank to the vehicle cooling system. Gasses are simply accumulated near the top of the tank, which necessarily must be a pressurized tank to maintain the cooling system pressure necessary for its proper operation. Consequently, the systems disclosed in the Pabst patents are less effective than the systems disclosed in the Avrea patents for removing accumulated air and other gasses from the cooling system.

A major shortcoming in any coolant recovery system utilizing a vacuum return for pulling fluid from the accumulator back into the vehicle cooling system or radiator is that if there is a leak in the cooling system for the vehicle, such as caused by a leaky heater hose or any of the radiator hoses, no vacuum is created when the engine cools down. Air then is drawn into the main system through the leak. Consequently, coolant remains in the recovery bottle and frequently, the owner, checking the coolant in the recovery bottle, assumes that coolant is in the engine in sufficient quantities when this is not the case.

In systems of the type shown in the Pabst patents, the effective separation of gasses from the liquid coolant which is achieved by the Avrea patents is not present. The equalization tanks of Pabst are located above the radiator; so that if there is a leak in the vehicle cooling system, the fluid in the tanks will flow into the system, even if no vacuum is present. While this overcomes one of the disadvantages of the Avrea systems, the effective separation of air and gasses from the liquid coolant of Avrea is not accomplished by the Pabst systems.

Accordingly, it is desirable to provide a coolant recovery system for use with liquid-cooled internal combustion engines and the associated cooling radiator used in cooling systems for such engines which is not subject to the aforementioned disadvantages but which incorporates positive and effective coolant recovery and positive anti-aeration of the liquid coolant in the cooling system for the vehicle.

SUMMARY OF THE INVENTION

Accordingly, it is an object of this invention to provide an improved coolant recovery system for use with a liquid-cooled internal combustion engine.

It is another object of this invention to provide an improved positive anti-aeration system for the cooling system of a liquid-cooled internal combustion engine.

It is an additional object of this invention to provide an improved coolant recovery system for the cooling system of a liquid-cooled internal combustion engine which permits maximum recovery of coolant in the event of loss of pressurization in the vehicle cooling system.

It is a further object of this invention to provide an improved coolant recovery system for a pressurized engine cooling system which provides positive anti-aeration of the engine cooling system and positive recovery of all fluid, even when pressure loss occurs in the cooling system.

In accordance with a preferred embodiment of this invention, a coolant recovery system for use with the cooling system of a liquid-cooled internal combustion engine includes an accumulator tank with an opening in its bottom. The bottom of the accumulator tank is located above the filler opening of the cooling system. A first passage interconnects the opening in the bottom of the accumulator tank with the cooling system and has a check valve in it for blocking liquid flow from the cooling system to the accumulator tank, while permitting free liquid flow from the accumulator tank to the cooling system. A second passage, separate from the first passage, is connected between the upper portion of the cooling system and the accumulator tank. A second, normally-closed, pressure-operated valve is located in the second passage to open when the pressure in the cooling system exceeds a predetermined pressure greater than ambient atmospheric pressure. This permits coolant liquid and gasses in the upper portion of the cooling system to flow into the accumulator tank. The second valve blocks any flow of fluid from the accumulator tank to the cooling system through the second passage. The accumulator tank is vented to atmosphere to permit venting of gasses in the tank, and a filler opening is provided in the accumulator tank for permitting the addition of coolant liquid to it.

DETAILED DESCRIPTION

Figure 1:
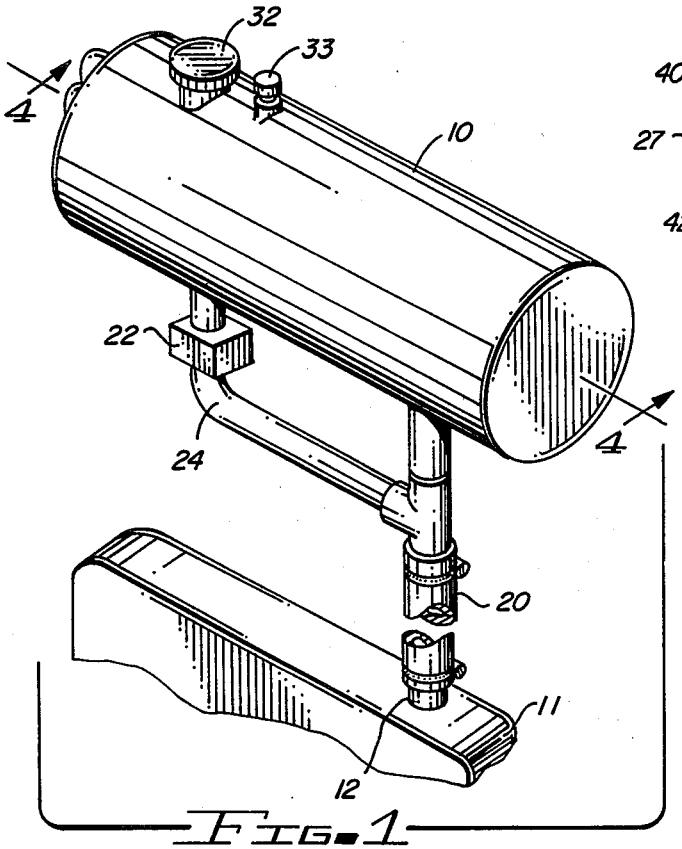
FIG. 1 is a top right perspective view of a preferred embodiment of the invention.
Figure 2:
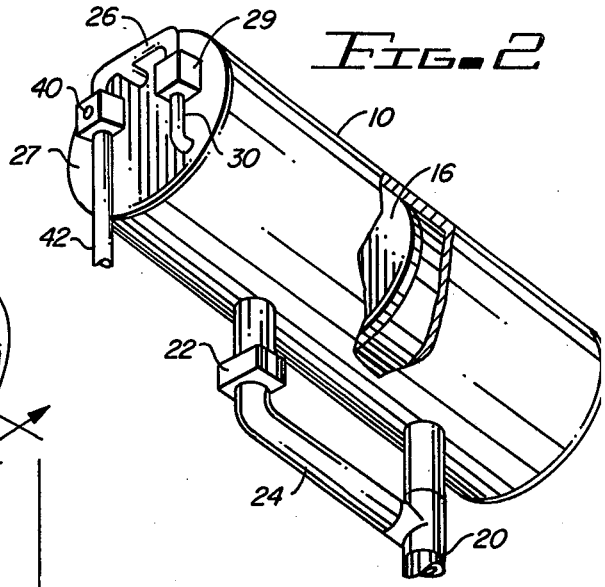
FIG. 2 is a bottom left perspective view of the embodiment shown in FIG. 1.
Figure 3:
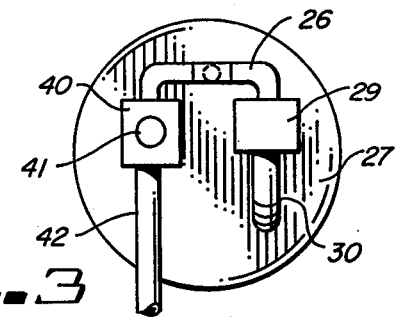
FIG. 3 is a left end view of the embodiment shown in FIGS. 1 and 2.

Reference now should be made to the drawings in which the same reference numbers are used in the various figures to designate the same or similar components.

First, reference should be made to the embodiment shown in FIGS. 1 through 5. This embodiment is illustrated in the form of an elongated cylindrical tank 10 of the same general dimensions (or somewhat larger) commonly used for surge tanks in buses, trucks and the like. The tank 10 is illustrated as being mounted above a radiator 11. The radiator 11 constitutes part of the cooling system for an internal combustion engine (such as a conventional diesel or gasoline engine) used to power the bus or truck in which the system is used. Since the cooling system is otherwise standard, no details of that system or its operation are shown in any of the drawings of this application. The relationship, however, of the tank 10 with respect to the radiator 11 is such that wherever the tank 10 is located, it is placed physically above the filler opening 12 of the radiator.

The tank 10 shown in FIGS. 1 through 5 is not a standard tank, but instead is divided into two compartments, 14 and 15, by means of an internal plate 16. This is shown most clearly in FIGS. 4 and 5. The plate 16 completely seals the compartments 14 and 15 from one another, causing them to be independent (effectively creating two tanks). At the bottom of each of the compartments are openings, 17 and 18, respectively. The opening 18 is connected by means of a first pipe or passage 20 to the filler opening 12 of the radiator 11. The passage 20 is an open passage which permits free flow of fluid in both directions between the compartment 15 and the radiator 11.

The opening 17 is connected through a gravity-opened check valve 22 (preferably a ball check valve) and a second pipe or passage 24 to the passage 20 to permit communication with the radiator 11 through the filler opening 12 from the tank 14. Thus, when there is no pressure in the cooling system of the vehicle and therefore, in the radiator 11, fluid is permitted to flow from the tank 14 through the opened valve 22 into the radiator 11 by means of the pipes 20 and 24. Once pressure builds up in the radiator 11, however, the gravity-opened check valve 22 is closed (as shown in FIG. 4) to prevent any fluid flow from the radiator into the tank 14.

The compartment 15 of the tank 10 is a sealed compartment, with the exception of the opening 18 and an opening in the end of a pipe 26 which extends from the top of the tank 15 through the end wall 27 of the compartment 14 where a pressure actuated check valve 29 is located. The check valve 29 permits fluid flow only in the downward direction as viewed in FIGS. 1 through 5, and supplies fluid through a pipe 30 back into the interior of the accumulator tank compartment 14.

Figure 4:
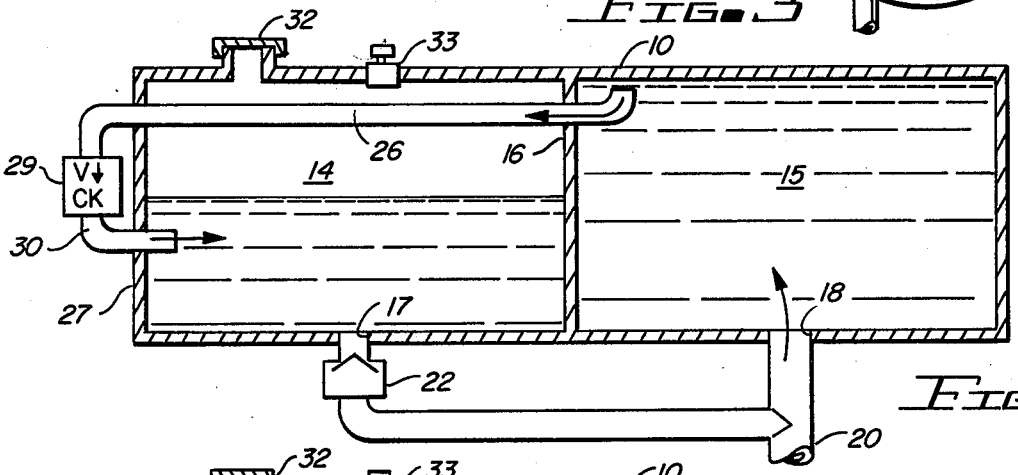
FIGS. 4 and 5 are cross-sectional views of the embodiment shown in FIGS. 1 and 2.
Figure 5:
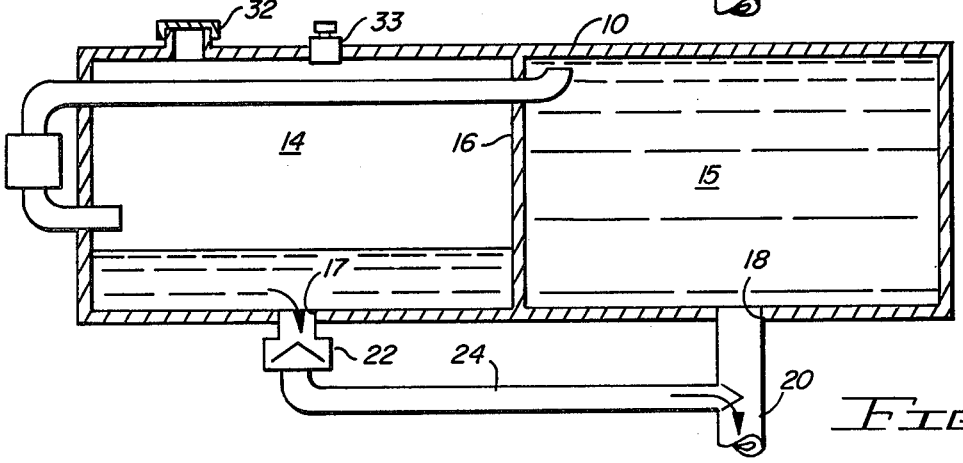

As is apparent from an examination of FIGS. 4 and 5, no other openings are present in the compartment 15. The accumulator tank compartment 14, however, has a filler cap 32 located in its top to permit the addition of coolant to the compartment 14 when desired. This filler cap 32 is used to initially supply coolant to the vehicle cooling system and to replenish fluid whenever this becomes necessary. As shown in FIGS. 4 and 5, a separate air vent 33 also is located in the top of the compartment 14 to vent any gasses present in the compartment 14 to the atmosphere. This air vent prevents free flow of air and other gasses in both directions into and out of the compartment 14 in a conventional fashion. The air vent 33 could be incorporated as an integral part of the cap 32. If this were done, only a single vented cap opening into the compartment 14 then would be necessary. The arrangement illustrated causes the compartment 15 to function as a "high pressure" compartment and the compartment 14 as a "low pressure" compartment.

When initial fill-up of the system is to be done, the cap 32 in the accumulator tank section 14 is opened. Coolant fluid then is poured through the opening and flows from the compartment 14 through the open gravity-opened check valve 22, as illustrated in FIG. 5, into the radiator 11 and the vehicle cooling system by way of the pipes 20 and 24. Air, which is displaced from the vehicle cooling system and radiator by such filling, initially enters the compartment 15, and some bubbles up through into the fluid in the chamber 14. To provide a pressure relief for air, and ultimately fluid, entering the compartment 15, a pressure relief valve 40 is interconnected to one arm of the pipe 26 located outside the end 27 of the tank 10. The valve 40 includes a button 41 which may be depressed to open the line from the pipe 26 through to a discharge pipe 42, illustrated most clearly in FIG. 3. When the button 40 is depressed, any air which is compressed in the chamber 15 passes through the pipe 26 and out through the open pressure relief valve 40 and pipe 42 to the atmosphere outside the tank 10.

Once the vehicle cooling system and radiator are full, fluid fills the pipes 20 and 24. Continued introduction of additional cooling fluid into the filler opening in the compartment 14 then causes fluid to continue to flow through the open check valve 22, the pipe 24, and upwardly and into the tank 15. As long as the pressure relief button 41 is depressed, the rising fluid simply drives air out through the pipe 26 and the pipe 42 to the atmosphere during this operation. The filling continues until the compartment 14 is approximately ⅔ full. The compartment 15 also will achieve an equal liquid level at the same time.

The cap 32 then is replaced over the filler opening in the compartment 14 and operation of the vehicle commences. When the fluid in the vehicle cooling system gets hot, pressure builds up and causes the check valve 22 to close, as shown in FIG. 4, since this pressure is greater than the ambient atmospheric pressure on top of the fluid in the accumulator tank compartment 14. At the same time, however, a pressure build-up in the high pressure compartment 15 takes place. When this pressure exceeds a pre-set threshold ascertained by the parameters of the pressure-actuated check valve 29, air and other gasses and ultimately fluid under pressure in the tank 15 pass in the direction of the arrow shown in FIG. 4 through the pipe 26, the check valve 29, and into the accumulator tank compartment 14. Typically, the check valve 29 is set to open at a pressure of 10 lbs. per square inch (psi). The actual pressure is determined by the characteristics of the remainder of the cooling system. It is apparent that, after a few cycles, all of the air and entrapped gasses which may be present in the vehicle cooling system and originally present in the upper part of the compartment 15 are purged out through the pipe 26 into the accumulator compartment 14. These gasses are vented then to the atmosphere through the air vent 33. The result is that the compartment 15 ultimately becomes completely full of fluid and no gasses are present. This is the normal operating condition of the vehicle.

When the engine is stopped and permitted to cool down, the coolant fluid in the cooling system contracts, as is well known. In a system which has no leaks in it, a vacuum is created. This then causes the check valve 22 to open and fluid flows from the compartment 14 into the vehicle radiator 11 in the direction of the arrows shown in FIG. 5. This continues, with no fluid being withdrawn from the pressurized compartment 15, since the check valve 29 does not permit reverse fluid flow from the compartment 14 into the compartment 15. Normally, there is sufficient fluid in the system to cause a fluid level to remain in the compartment 14, as illustrated in FIG. 5, when complete cool-down has occurred. The stand-by condition of the system then includes relative fluid levels of the type illustrated in FIG. 5 (low in compartment 14 and compartment 15 is completely filled).

If, for some reason, there is a leak somewhere in the cooling system or the other cooling fluid connections used in the vehicle, vacuum pressure is lost. This is a situation which renders inoperative those systems requiring vacuum in the system to withdraw fluid from the accumulator bottle. In such an event, prior art systems leave fluid present in the accumulator even though the vehicle cooling system may be dangerously low in fluid. This gives a false sense of security to persons maintaining or operating the vehicle in which the system is installed. Such a situation, however, cannot arise with the system shown in FIGS. 1 through 5.

If vacuum should be lost in the vehicle cooling system, the gravity-operated check valve 22 continues to remain open to permit all of the fluid to drain out of the accumulator compartment section 14. If this is still insufficient to complete filling of the radiator 11, the balance of the fluid then drains out of the high pressure compartment 15. Air enters into the high pressure compartment 15 from the accumulator tank compartment 14 (now empty of liquid) through the check valve 22 and the pipe 24 and bubbles upwardly into the compartment 15 as the fluid in that tank falls freely by gravity through the opening 18 into the radiator 11.

If there is a leak in the cooling system for the vehicle engine, all of the fluid ultimately would drain out of both tanks 14 and 15. This readily can be ascertained by conventional means such as sight tubes located in the end of the tank sections (not shown) or by means of electrical sensors of the type commonly used in vehicles today for indicating fuel levels, oil levels, windshield washer levels, and the like. The system, however, has a positive way of recovering all of the fluid in both the high pressure compartment 15 and the low pressure accumulator compartment 14, irrespective of the pressure or vacuum condition of the vehicle cooling system. Coolant is returned to the vehicle cooling system either by way of a vacuum withdrawal, or by gravity. At the same time, the system functions to positively remove air and other gasses from the coolant which normally is recirculated in the system through the high pressure compartment 15 to the compartment 14, from which such gasses are purged, as described above.

Figure 6:
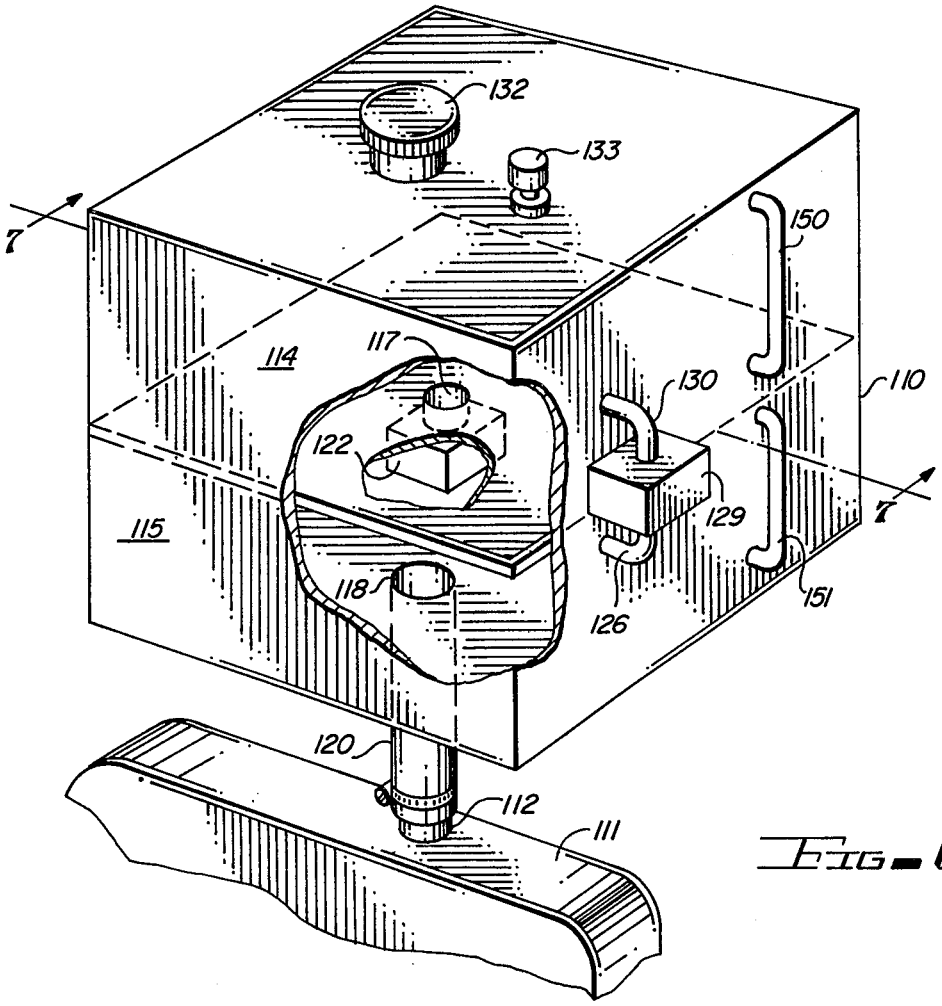
FIG. 6 is a partially cut-away perspective view of another embodiment of the invention.
Figure 7:
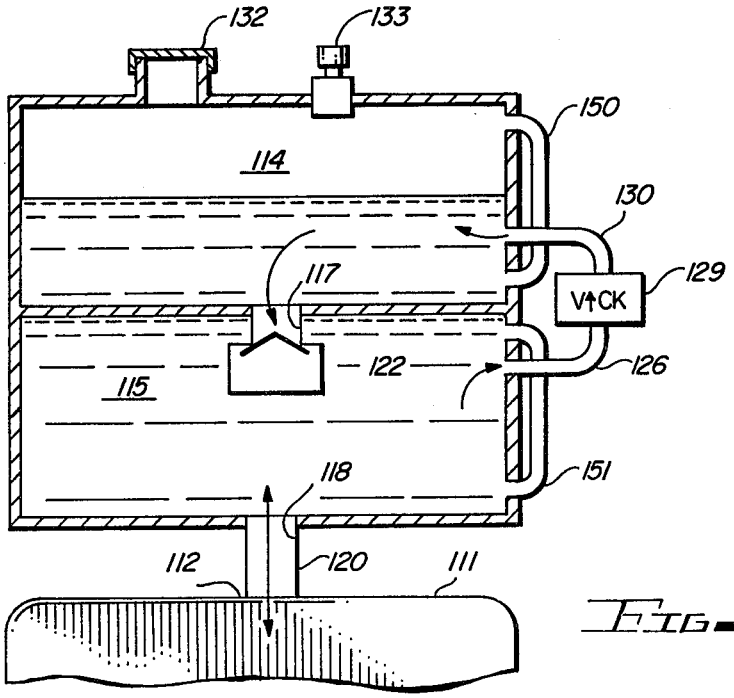
FIG. 7 is a cross-sectional view of the embodiment shown in FIG. 6.

An alternative embodiment of the invention is shown in FIGS. 6 and 7. Instead of employing an elongated dual compartment cylindrical tank 10, as illustrated in FIGS. 1 through 5, the invention may be implemented by stacking the two tank compartments, one on top of the other. In addition, while a cylindrically-shaped tank provides a greater strength-to-weight ratio of materials, it is possible to build the structure in the form of rectangular tanks formed of flat plates, as well as in the form illustrated in the embodiment of FIGS. 1 through 5. Consequently, the embodiment shown in FIGS. 6 and 7 employs a rectangular tank which essentially is turned up on end from the version shown in FIGS. 1 through 5. In all other respects, the operation of the embodiment shown in FIGS. 6 and 7 is the same as that illustrated and described above in conjunction with FIGS. 1 through 5.

In the embodiment shown in FIGS. 6 and 7, the same general reference numbers employed in the embodiment of FIGS. 1 through 5 are used, with the exception that each is in a 100 series numbering, for example, the overall tank is 110, while the accumulator tank compartment is 114, and the high pressure tank compartment is 115. A similar corresponding number designation is made for all of the other components to facilitate correlation between the components of the two different embodiments shown in the drawings.

The high pressure compartment 115 is located directly beneath the accumulator tank compartment 114; and the opening 117 in the bottom of the accumulator tank compartment 114 is through a gravity-operated check valve 122 directly into the compartment 115. This is shown most clearly in the cross-sectional view of FIG. 7. In all other respects, the embodiment of FIGS. 6 and 7 operates in the same manner as the embodiment of FIGS. 4 and 5 described above. In the embodiment of FIGS. 6 and 7, however, it is not necessary to employ the pressure relief valve 40 and tube 42 during the initial fill-up of the system, since the arrangement permits direct venting of air from the vehicle cooling system, the compartment 115, and the compartment 114 through the vent 133 when coolant liquid is poured into the compartment 114 through the filler opening 132.

Upon initial fill-up, fluid flows out of the compartment 114 through the opening 117, through the gravity-opened check valve 122 and into the radiator 111 located directly beneath the bottom opening 118 of the tank compartment 115. Once fluid reaches a level typically as illustrated in FIG. 7, the cap on the filler opening is closed.

When pressure builds up in the radiator 111 during operation of the vehicle in which the internal combustion engine is located, the gasses which may have been entrained somewhere in the vehicle cooling system are passed outwardly, along with excess fluid, through the pipe 126 and the pressure-actuated check valve 129, the pipe 130 into the accumulator tank compartment 114. This operation is comparable to the operation described above under similar conditions for the embodiment of FIGS. 1 through 5. At the same time, the gravity-operated check valve 122 is forced closed, so long as pressure in excess of atmospheric pressure exists in the system.

Upon cool-down, the valve 122 opens and fluid drains from the accumulator tank compartment 114 into the compartment 115 and from there, into the radiator 111 through the pipe 120. This is in the direction of the arrow shown in the center of the cut-away cross-section of FIG. 7.

As indicated previously in conjunction with the description of the embodiment of FIGS. 1 through 5, clear sight tubes may be employed to assist persons in determining whether there is sufficient liquid level in the tank compartments 114 and 115. Two such tubes, 150 and 151, are shown in the embodiment of FIGS. 6 and 7. These typically are made of clear plastic material and the liquid level in the tanks 114 and 115 is readily apparent by observing the tubes 150 and 151. Alternatively, electrical sensors attached to warning indicator lamps on the dashboard of the vehicle in which the system is used may be employed.

The two embodiments which have been described above in conjunction with FIGS. 1 through 7 are to be considered illustrative of the invention, and not as limiting. The invention provides positive anti-aeration and positive coolant recovery for a vehicle in which it is used. Various other forms of the dual tank arrangement may be employed (including construction as an integral part of the radiator) which will function in the same manner as the two different embodiments which have been described in detail above. The particular shape of the tanks and their actual location in the vehicle is not of consequence, as long as the tanks are located above the filler opening in the vehicle radiator or such other point in the vehicle cooling system connected to the opening 17 or 18 of the embodiment of FIG. 1 or to the opening 118 of the embodiment of FIGS. 6 and 7. Other changes and modifications will occur to those skilled in the art without departing from the true scope of the invention.

I claim:

1. A coolant recovery system for use with the cooling system of a liquid-cooled internal combustion engine, having a cooling radiator and a filler opening on the top of the cooling system to provide positive anti-aeration of the engine cooling system and positive recovery of all fluid, said recovery system including in combination:

an accumulator tank means with an opening in the bottom thereof located with such opening above the cooling system filler opening;

first passage means including first check valve means therein for permitting free liquid flow from the opening in the bottom of said accumulator tank means to said cooling system filler opening and for blocking liquid flow from said cooling system filler opening to said accumulator tank means through said first passage means;

a second passage separate from said first passage connected between the upper portion of said cooling system and said accumulator tank means;

a second valve means in said second passage for closing said second passage and adapted to open when the pressure in said cooling system exceeds a predetermined pressure greater than ambient atmospheric pressure to permit coolant liquid and gasses in the upper portion of said cooling system to flow into said accumulator tank means, said second valve means blocking flow of fluid from said accumulator tank means to said cooling system through said second passage;

filler opening means in said accumulator tank means for permitting the addition of coolant liquid thereto; and means for venting gasses in said accumulator to the atmosphere.

2. The combination according to claim 1 wherein said second valve means comprises a second check valve means for blocking all fluid flow from said accumulator tank means through said second passage to said cooling system and for opening to permit fluid flow into said accumulator tank means only when a predetermined pressure greater than ten pounds per square inches exists in said cooling system.

3. The combination according to claim 1 wherein said first check valve is a gravity opening check valve.

4. The combination according to claim 3 wherein said second valve means comprises a second check valve means for blocking all fluid flow from said accumulator tank means through said second passage to said cooling system and for opening to permit fluid flow into said accumulator tank means only when a predetermined pressure greater than ten pounds per square inches exists in said cooling system.

5. The combination according to claim 1 wherein the opening in the bottom of said accumulator tank means is at the lowest point thereof.

6. The combination according to claim 1 wherein said first passage means comprises high pressure tank means positioned between the bottom of said accumulator tank means and said cooling system filler opening, with an opening in the bottom of said high pressure tank means connected with said cooling system filler opening to permit free flow of liquids in both directions between said high pressure tank means and said cooling system; said first check valve means is located between an opening in the bottom of said accumulator tank means and an opening in the top of said high pressure tank means; and said second passage is connected between the upper portion of said high pressure tank means and said accumulator tank means.

7. The combination according to claim 6 wherein said accumulator tank means and said high pressure tank means are fabricated as a single unit with a common partition comprising the bottom of said accmulator tank means and the top of said high pressure tank means, said partition having an opening therein comprising both the opening in the bottom of said accumulator tank means and the opening in the top of said high pressure tank means with said first check valve means located in such opening.

8. The combination according to claim 7 wherein said first check valve is a gravity opening check valve.

9. The combination according to claim 8 wherein said second valve means comprises a second check valve means for blocking all fluid flow from said accumulator tank means through said second passage to said cooling system and for opening to permit fluid flow into said accumulator tank means only when a predetermined pressure greater then ten pounds per square inches exists in said cooling system.

10. A coolant recovery system for use with a liquid-cooled internal combustion engine having a cooling radiator with a filler opening on the top thereof to provide positive anti-aeration of the engine cooling system and positive recovery of all fluid, said recovery system including in combination:

first and second enclosed tank means mounted with the bottoms thereof above the filler opening in said radiator;

first passage means between the bottom of said first tank and the filler opening of said radiator to permit free liquid flow out of said first tank means into said radiator and from said radiator into said first tank means;

second passage means separate from said first passage means connected between the upper portion of said first tank means and said second tank means;

normally closed first valve means in said second passage means adapted to open when the pressure in said first tank means exceeds a predetermined pressure greater than ambient atmospheric pressure to permit coolant liquid and gasses in the upper portion of said first tank means to flow into said second tank means, said first valve means blocking all fluid flow from said second tank to first tank through said second passage means; p1 an opening in the bottom of said second tank means;

third passage means interconnecting the opening in the bottom of said second tank means with the filler opening in said radiator; and check valve means in said third passage means for permitting free liquid flow from said second tank means to said radiator and for blocking fluid flow from said radiator to said second tank means;

filler opening means in said second tank means to permit the addition of coolant liquid thereof; and means for venting gasses in said second tank means to the atmosphere.

11. The combination according to claim 10 wherein said check valve means is a gravity opening check valve.

12. The combination according to claim 10 wherein said first and second tank means are fabricated as part of a common surge tank with a baffle separating said surge tank into said first and second tanks means, respectively.

13. The combination according to claim 12 wherein said surge tank is in the form of a horizontally mounted elongated cylinder, the ends of which are enclosed, with said cylinder positioned to cause the openings in the bottom of both of said first and second tank means to be located above the filler opening of said cooling radiator.

14. The combination according to claim 13 wherein said check valve means is a gravity opening check valve.

* * * * *